United States Patent [19]

Frydman

[11] 4,253,091

[45] Feb. 24, 1981

[54] METHOD AND APPARATUS FOR DETECTION OF ALARM CONDITIONS

[75] Inventor: Jehuda Frydman, Fairport, N.Y.

[73] Assignee: Mobil Oil Corporation, New York, N.Y.

[21] Appl. No.: 757,125

[22] Filed: Jan. 5, 1977

[51] Int. Cl.[3] ..... G08B 29/00; G08B 26/00

[52] U.S. Cl. ..... 340/506; 340/505; 340/508; 340/518

[58] Field of Search ..... 340/409, 408, 214, 276, 340/152 T, 413, 147 C, 500, 505, 506, 518, 523, 508; 364/550

[56] References Cited

U.S. PATENT DOCUMENTS

| | | | |
|---|---|---|---|
| 2,306,654 | 12/1942 | Triman | 340/162 |
| 2,695,994 | 11/1954 | Lode | 340/227.1 |
| 2,812,976 | 11/1957 | Hasenkamp | 340/413 |
| 3,540,042 | 11/1970 | Morrow et al. | 340/409 |
| 3,618,069 | 11/1971 | Evans | 340/276 |
| 3,657,714 | 4/1972 | Kessler | 340/409 |
| 3,735,396 | 5/1973 | Getchell | 340/409 |
| 3,846,793 | 11/1974 | Cook | 340/409 |
| 3,848,241 | 11/1974 | LeNay et al. | 340/409 |
| 3,955,183 | 5/1976 | McBrian | 340/214 |
| 3,982,242 | 9/1976 | Sheffield et al. | 340/409 |
| 4,030,095 | 6/1977 | Dalman | 340/296 |

*Primary Examiner*—John W. Caldwell, Sr.
*Assistant Examiner*—Donnie L. Crosland
*Attorney, Agent, or Firm*—C. A. Huggett; William J. Scherback

[57] ABSTRACT

Method and apparatus for a condition-sensing system including features of checking the integrity of the system and detecting the presence of an alarm condition. Condition-sensing system is described as a fire alarm system for a central station employing a modification of the McCulloh circuit. A plurality of fire detection loops including normally open circuit detectors are each powered at opposite ends. Each leg of each loop is sequentially checked for integrity and then the detectors are checked for alarm conditions. A switching system is employed for the sequential operations. A programmable controller is disclosed as a switching system.

10 Claims, 14 Drawing Figures

FIG. 12

INPUTS →

OUTPUTS ↓

| | 0 | 1 | 2 | 3 | 4 | 5 | 6 | 7 | 10 | 11 | 12 | 13 | 14 | 15 | 16 | 17 |
|---|---|---|---|---|---|---|---|---|---|---|---|---|---|---|---|---|
| 100 | AMD1 200 | BSR7 201 | CSR7 202 | EME3 203 | EHD15 204 | GMD1 205 | HFW5 206 | JSR9 207 | 40 AMD1/2 | 41 BSR7/8 | 42 CSR7/8 | 43 EME3/4 | 44 EHD15/16 | 45 GMD1/2 | 46 HFW5/6 | 47 JSR9/10 |
| 101 | AME3 210 | BSR9 211 | DMD1 212 | ESR5 213 | FMD1 214 | GME3 215 | HFG7 216 | ESR11 217 | 50 AME3/4 | 51 BSR9/10 | 52 DMD1/2 | 53 ESR5/6 | 54 FMD1/2 | 55 GME3/4 | 56 HFG7/8 | 57 ESR11/12 |
| 102 | ASR5 220 | BSR11 221 | DME3 222 | ESR7 223 | FME3 224 | GFW5 225 | JMD1 226 | SP5 227 | 60 ASR5/6 | 61 BSR11/12 | 62 DME3/4 | 63 ESR7/8 | 64 FME3/4 | 65 GFW5/6 | 66 JMD1/2 | 67 SP5/6 |
| 103 | BMD1 230 | CMD1 231 | DSR5 232 | ESR9 233 | FSR5 234 | GFG7 235 | JME3 236 | SP7 237 | 70 BMD1/2 | 71 CMD1/2 | 72 DSR5/6 | 73 ESR9/10 | 74 FSR5/6 | 75 GFG7/8 | 76 JME3/4 | 77 SP7/8 |
| 104 | BME3 240 | CME3 241 | DSR7 242 | KEW11 243 | FFW7 244 | HMD1 245 | JFW5 246 | SP9 247 | 140 BME3/4 | 141 CME3/4 | 142 DSR7/8 | 143 KEW11/12 | 144 FFW7/8 | 145 HMD1/2 | 146 JFW5/6 | 147 SP9/10 |
| 105 | BSR5 250 | CSR5 251 | EMD1 252 | EHD13 253 | FFG9 254 | HME3 255 | JFG7 256 | SP11 257 | 150 BSR5/6 | 151 CSR5/6 | 152 EMD1/2 | 153 EHD13/14 | 154 FFG9/10 | 155 HME3/4 | 156 JFG7/8 | 157 SP11/12 |
| 106 | 40 AMD1/2 | 41 BSR7/8 | 42 CSR7/8 | 43 EME3/4 | 44 EHD15/16 | 45 GMD1/2 | 46 HFW5/6 | 47 JSR9/10 | AMD2 200 | BSR8 201 | CSR8 202 | EME4 203 | EHD16 204 | GMD2 205 | HFW6 206 | JSR10 207 |
| 107 | 50 AME3/4 | 51 BSR9/10 | 52 DMD1/2 | 53 ESR5/6 | 54 FMD1/2 | 55 GME3/4 | 56 HFG7/8 | 57 ESR11/12 | AME4 210 | BSR10 211 | DMD2 212 | ESR6 213 | FMD2 214 | GME4 215 | HFG8 216 | ESR12 217 |
| 110 | 60 ASR5/6 | 61 BSR11/12 | 62 DME3/4 | 63 ESR7/8 | 64 FME3/4 | 65 GFW5/6 | 66 JMD1/2 | 67 SP5/6 | ASR6 220 | BSR12 221 | DME4 222 | ESR8 223 | FME4 224 | GFW6 225 | JMD2 226 | SP6 227 |
| 111 | 70 BMD1/2 | 71 CMD1/2 | 72 DSR5/6 | 73 ESR9/10 | 74 FSR5/6 | 75 GFG7/8 | 76 JME3/4 | 77 SP7/8 | BMD2 230 | CMD2 231 | DSR6 232 | ESR10 233 | FSR6 234 | GFG8 235 | JME4 236 | SP8 237 |
| 112 | 140 BME3/4 | 141 CME3/4 | 142 DSR7/8 | 143 KEW11/12 | 144 FFW7/8 | 145 HMD1/2 | 146 JFW5/6 | 147 SP9/10 | BME4 240 | CME4 241 | DSR8 242 | KEW12 243 | FFW8 244 | HMD2 245 | JFW6 246 | SP10 247 |
| 113 | 150 BSR5/6 | 151 CSR5/6 | 152 EMD1/2 | 153 EHD13/14 | 154 FFG9/10 | 155 HME3/4 | 156 JFG7/8 | 157 SP11/12 | BSR6 250 | CSR6 251 | EMD2 252 | EHD14 253 | FFG10 254 | HME4 255 | JFG8 256 | SP12 257 |

METHOD AND APPARATUS FOR DETECTION OF ALARM CONDITIONS

BACKGROUND OF THE INVENTION

This invention relates to alarm detection, particularly of the open circuit detector type and more particularly to a fire alarm method and system having provision for sequentially sensing for integrity as well as alarm conditions.

PRIOR ART

State-of-the-art techniques are represented by the publication HANDBOOK OF INDUSTRIAL LOSS PREVENTION, Second Edition, published by McGraw-Hill, particularly Chapter 26 entitled "Industrial Fire-Alarm Systems". Open circuit alarm devices are commonly utilized in normally closed electrically supervised circuits employing a McCulloh loop. Power is normally continuously applied to one end of the loop. Should an accidental break occur in the circuit, an alarm will sound and provision can be made now to supply power to the opposite end of the loop.

Prior art systems require that each loop be independent of every other loop, thus adding to the expense of fire alarm systems for large industrial facilities. Power supplies must also be isolated to enable identification of breaks in the circuit loops. More specifically, supervision of the wiring is achieved by allowing a small current to flow continuously; and this current is sensed by an amplifier, thereby indicating wire continuity and system operability. Other methods depend on voltage balances to indicate proper system conditions. However, one of the weakest characteristics of these supervised systems is their dependence on very small level voltages or currents to sense system conditions. These voltages or currents are susceptible to power line voltage instability, temperature changes, component tolerances, and amplifier gain fluctuations. Improper functioning of the supervisory portion of the alarm system will trigger false trouble alarms or fail to annunciate a trouble when it exists. Accordingly, each zone or control loop requires a separate amplifier, making multizone or multiloop systems large and costly.

SUMMARY OF THE INVENTION

This invention overcomes many of the shortcomings of the state-of-the-art techniques described above. It provides methods and apparatus whereby a large number of zones are time-domain multiplexed which significantly reduces the cost of the system, and the use of higher sensing voltages enhances system reliability.

In accordance with the invention, the condition-sensing system includes at least one open circuit type environmental sensor having at least two terminals. A switch and alarm unit has at least two inputs and two outputs, with a first pair of communication channels extending over a first path interconnecting one of said outputs and one of said inputs, respectively, to said terminals of said sensor. A second pair of communication channels extends over a second path different from said first path interconnecting another of said outputs and another of said inputs, respectively, to said terminals of said sensor whereby said sensor is connected in parallel to and in common with said communication channels.

The switch unit sequentially and individually connects an output to one input and then to another input in turn to apply high voltages in order to sense integrity of the system as well as alarm conditions.

In accordance with another aspect of this invention, multiplexing principles are applied in order to reduce the number of inputs and outputs of the switching system. By utilizing sequential switching, one can associate one output with more than one input and vice versa, and thus achieve multiplexing and a resulting cost saving.

In accordance with a specific embodiment, a programmable controller is utilized to provide sequential switching functions between inputs and outputs as well as sensing for alarm conditions.

Other features and advantages of the invention will be better understood from the following description and the accompanying drawings.

BRIEF DESCRIPTION OF THE DRAWINGS

FIG. 12 is a matrix diagram of the various circuit connections performed in the utilization of the present invention.

DESCRIPTION OF THE PREFERRED EMBODIMENTS

Figure 1:
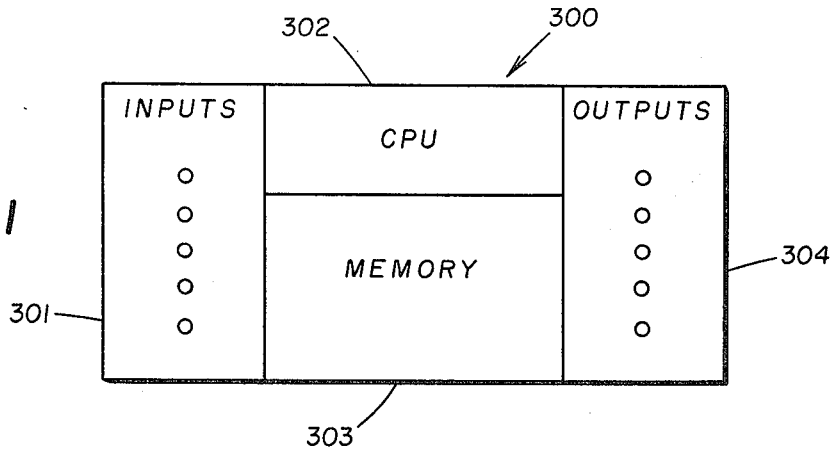
FIG. 1 is a block diagram of the component parts of a programmable controller useful in the practice of the present invention.

Referring now to FIG. 1 there is shown in block schematic form a programmable controller 300 useful in the practice of the present invention. The controller includes an input interface 301, a central processing unit (CPU) 302, a memory 303 and an output interface 304. The memory 303 contains the control algorithm as a list of instructions. The CPU 302 reads these instructions sequentially. The CPU 302 interprets these instructions and acts on one of many outputs comprising interface 304, turning it on or off, after checking the status of some inputs or outputs, according to the instructions in memory 303. To the input interface 301 are connected sensors of any desirable type, but for the present description, and not by way of limitation, sensors related to fire detection will be referred to such, for example as glass break stations, heat detectors, smoke detectors, etc. Likewise to the output interface will be connected actuators or displays such as alarm lights, evacuation horns, bells, fire door latches, etc. All switching is performed sequentially and at a rapid rate, for example 4 to 20 microseconds each. As will be shown the same functions can be provided by mechanically driven rotary switches; however, the solid state programmable controller is preferred because of its flexibility and rapidity of operation.

Figure 2:
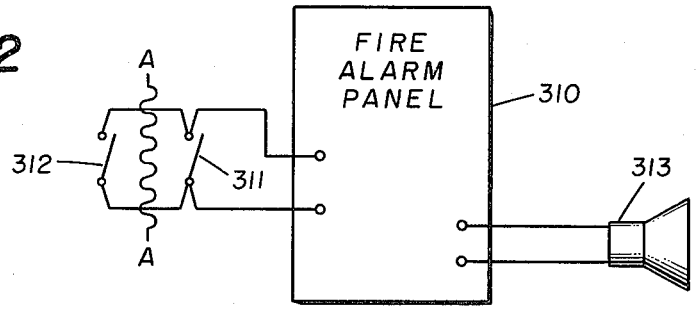
FIG. 2 PRIOR ART
FIG. 2 is a schematic representation of prior art systems.

In a typical fire alarm system as shown in FIG. 2 there are included an alarm panel 310, a loop including sensors 311 and 312, shown as normally open switches and an annunciator 313. Only one loop is shown, it being understood that a plurality of loops and many more sensors will be utilized.

Should an alarm condition occur switches 311 or 312 will close and annunciator 313 will sound. However, should the loop be open such as would occur if the wire or wires were severed at line A—A, sensor 312 would effectively be disabled. In similar systems where supervision features are added to check the integrity of the wires the loop will be closed at its end with a high impedance allowing a small current to flow continuously in absence of a break. But these require continuous flow and low currents which are sensed by amplifiers. Since each loop is duplicated costs mount with each loop.

Figure 3:
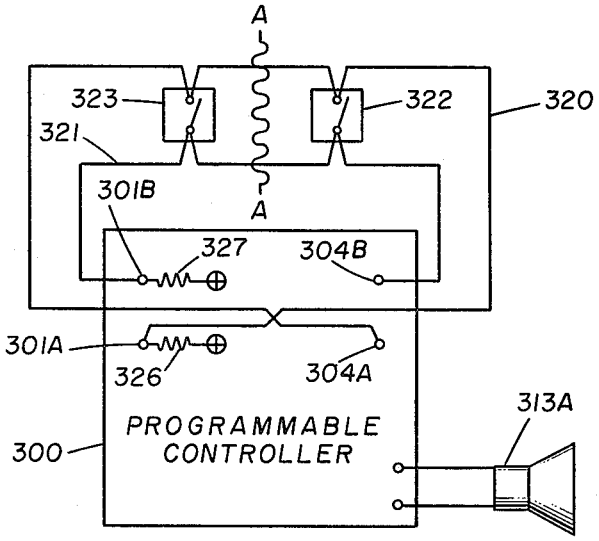
FIG. 3 is a schematic representation of a single loop system embodying the present invention.

In accordance with the present invention as illustrated, for purpose of simplicity by a single loop in FIG. 3, the alarm system remains fully operable even though the loop be open by a break at line A—A. The system of FIG. 3 includes a sequential switching system shown as programmable controller 300.

The loop includes two wires 320 and 321 and connected in parallel are two sensors 322 and 323. The sensors 322 and 323 for purpose of this description are normally open. The controller includes two inputs 301A and 301B and two outputs 304A and 304B. In a typical sequence of operation the status or integrity of the system is first checked, output 304B will be turned on and input 301B is sensed. If input 301B is on, this indicates that line or wire 321 is unbroken. Output 304B is turned off and output 304A is turned on. Input 301A is sensed. If input 301A is on, this indicates wire or line 320 is intact. If in the two steps just described, if continuity was not sensed at either inputs 301A or 301B an alarm, for example annunciator 313A, will sound indicating the lack of integrity of the loop. In this system full voltage is momentarily placed on each line sequentially.

In accordance with an important feature of the present invention is the crossing of the wires 320, 321 in each control loop. When tracing wire 321 from output 304B to input 301B the direction is counterclockwise. When tracing wire 320 from output 304A to input 301A the direction is clockwise. Such an arrangement provides for significantly increase system reliability, for even should the loop be severed at line A—A each alarm condition will be sensed. For example, when sensing for alarm conditions at the sensors, as opposed to the sensing for system integrity, output 304B will be turned on and input 301A sensed. Then output 304A is turned on and input 301B is sensed. If either input is on an alarm will sound the necessary action taken. It is readily apparent from tracing the circuits above described that an alarm will sound even if the break at A—A exists.

With the use of current-sinking D.C. output modules, and the use of pull-up resistors, a check may be made for grounded wires. The inputs and outputs in FIG. 3 are D.C. devices. The resistors 326 and 327 are connected respectively to inputs 301A and 301B and to the positive side of a suitable power supply. The resistor sizes can vary over a wide range. The outputs are current-sinking devices, such as open collector transistors. To sense a grounded wire such as wire 321, output 304B is set to an off position and input 301B is sensed. In the absence of a short a voltage will be sensed due to the presence of resistor 327. However, if the wire 321 is shorted the voltage will drop across resistor 326 and an alarm will be tripped.

The present invention lends itself to multiplexing techniques which reduce the number of inputs and outputs required for the desired number of loops. To illustrate how this is accomplished reference will be made to FIG. 4, then to FIG. 5 and then to FIG. 6.

Figure 4:
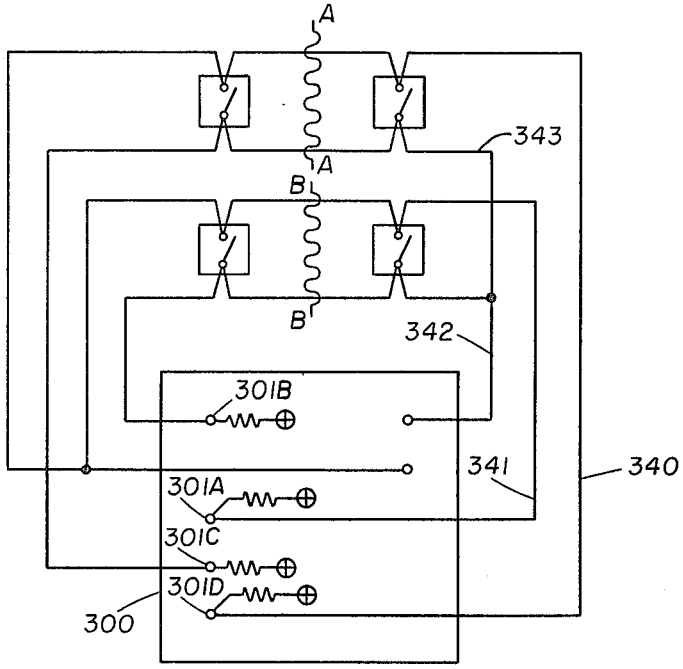
FIG. 4 illustrates an arrangement of two loops utilizing four outputs and two inputs.

In FIG. 4 two loops comprised of wires 340–343 are served by two outputs 304A and 304B and four inputs 301A, 301B, 301C, and 301D. When the output 304B is on, wire 343 is checked for continuity at input 301C, and wire 342 is checked for continuity at input 301B. Then output 304A is turned on and wire 341 is checked for continuity at input 301A. With output 304A on, wire 340 is checked for continuity at input 301D.

In order to sense alarm conditions output 304B is turned on and input 301A is sensed and then input 301D is sensed. If a signal is detected at either inputs an alarm will sound. Similarly with output 304A turned on sensing takes place at input 301B and at input 301C. There is preserved by this arrangement the capability of detecting alarm conditions even though the loops are severed, for example, at either A—A or B—B or both.

Figure 5:
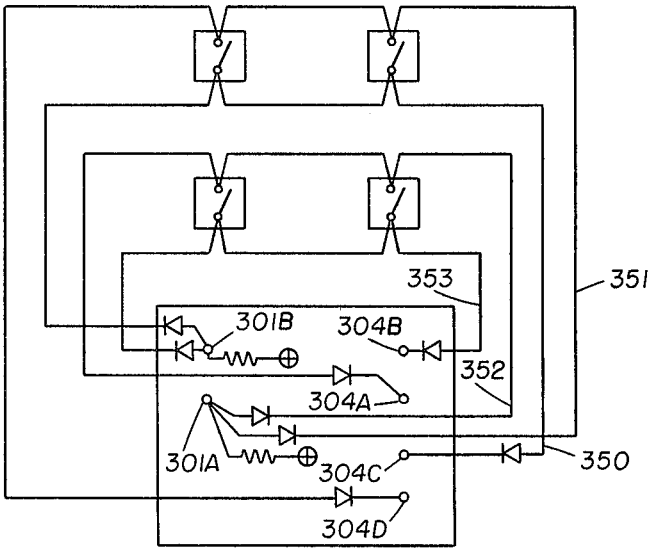
FIG. 5 illustrates an arrangement of two loops utilizing two outputs and four inputs.

On the other hand, as shown in FIG. 5, two inputs and four outputs may be utilized to accomplish the same functions as provided by four inputs and two outputs in FIG. 4. The loops, comprised of wires 350–353 are checked for integrity and alarm conditions in a manner similar to that described with respect to FIG. 4. FIG. 5 differs however in one other aspect and that is the provision of isolating or steering diodes connected as shown.

Figure 6:
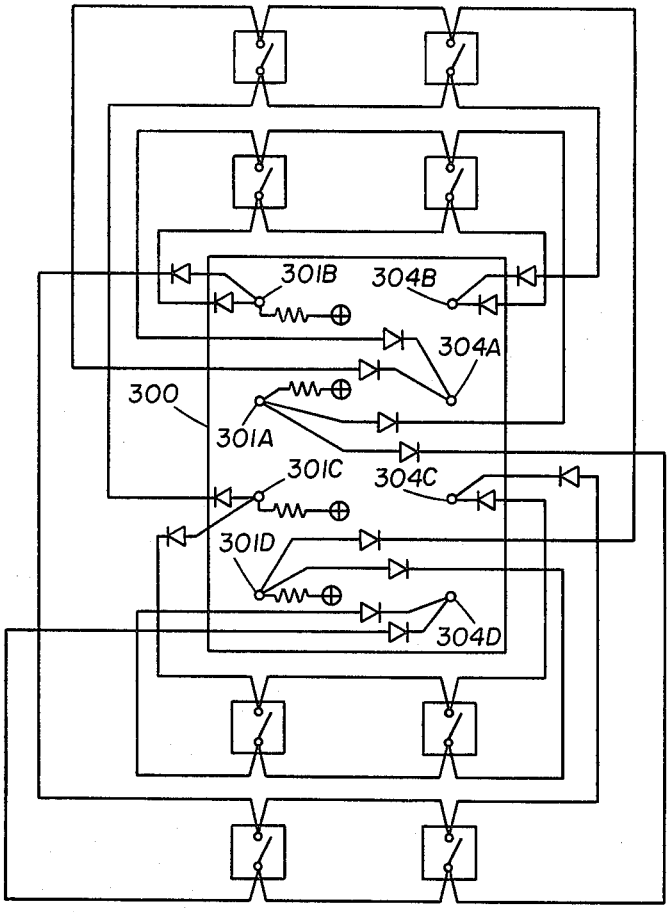
FIG. 6 illustrates an arrangement of four loops embodying the principles of FIGS. 4 and 5 and utilizing four outputs and four inputs.

It is now evident that multiplexing can be further employed and extended to any number of loops. FIG. 6 illustrates the use of four inputs and four outputs for four control loops, thus, combining the features of FIGS. 4 and 5.

The controller 300 of FIG. 6 includes four inputs 301A–301D with associated pull-up resistors and diodes, as well as four outputs 304A–304D with associated diodes. Again the arrangement provides for a reliable alarm system due to crossing of the wires in the loops and for reduced cost.

Figure 7:
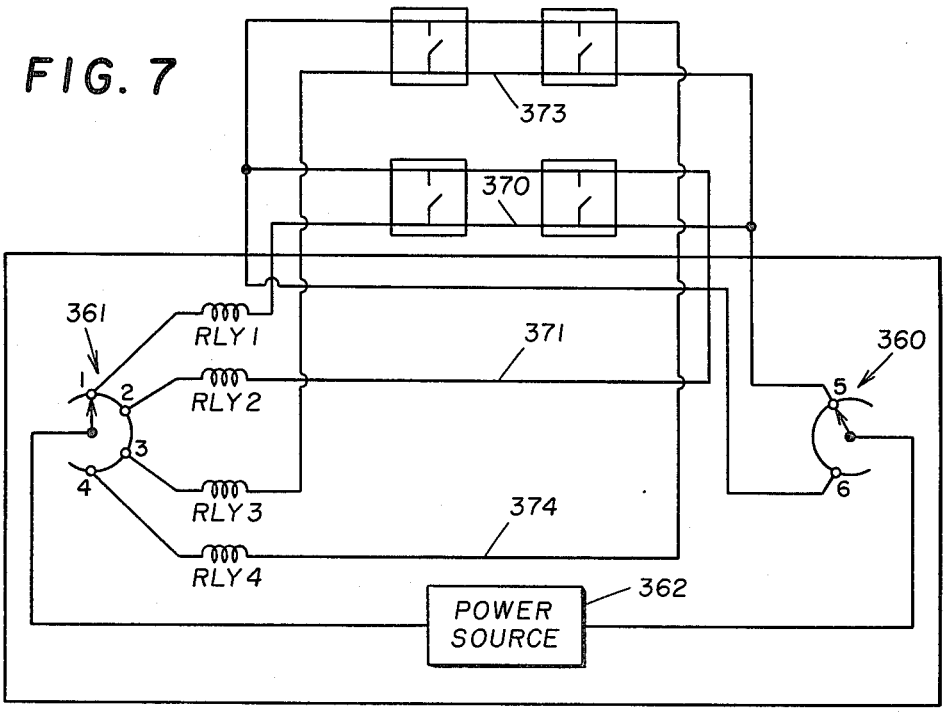
FIG. 7 illustrates an arrangement equivalent to a programmable controller wherein the various circuits are completed by way of rotary switches.

The controller for implementing the sequential switch operations may be provided by various systems or mechanisms. One such system is shown in FIG. 7 comprised of mechanically driven rotary switches 360 and 361. Switch 360 with fixed contacts 5 and 6 provides the output and switch 361 with fixed contacts 1–4 provides the input. Power is supplied from source 362. For simplicity, only that operation concerned with supervision of loop integrity will be described. With output 5 connected the condition of line 370 will be checked by sensing input 1. If line or wire 370 is intact, relay RLY1 will pick up. Then with output 6 turned on the condition of line or wire 371 will be checked by sensing input 2. Next, output 5 is again turned on and the condition of wire 373 is checked by sensing at input 3. Once again output 6 is turned on and the condition of wire 374 is checked by sensing at input 4.

While the invention may be practiced utilizing various systems to implement the sequential switching and sensing, it is preferred to utilize a programmable controller. One such controller is available from Struthers-Dunn, Inc. and identified as the S-D 77 Controller. A manual is available which covers the specifications of the controller as well as a full description how to program it. The manual is entitled S-D 77 Programmable Controller Programming Manual copyrighted 1974. It is further identified as Part Number 79,632. The S-D 77 has 20 isolated inputs and 12 outputs. In a system installed with the present invention 16 inputs and 12 outputs were utilized. The matrix of connections to outputs and inputs is shown in FIG. 12. The 12 outputs are numbered 100–107 and 110–113 and the 16 inputs are numbered 0–7 and 10–17.

The matrix of FIG. 12 provides all the necessary details to correspond with the software instructions sequence. It is important to note that the matrix as illustrated is divided into four quads; the upper left and the lower right detail the inputs/outputs combinations that will supervise the wiring, while the other two quads will sense actual fire alarm.

As each output is activated in sequence, one at a time, for example output 100, all the inputs are interrogated. Inputs 0 through 7 have wires AMD1 through SP11 connected to them, and current is expected to flow through wires, otherwise a maintenance alert is indicated. The other inputs 10 through 17 are also interrogated, but in this case, no wires are connected to them and to the active output 100; therefore, they are not expected to sense any current flow. If they do, this indicates that a contact has closed between the pairs of wires, such as AMD1-AMD2 or BSR7-BSR8, etc., and therefore a fire alarm is indicated.

In the illustrated matrix, the address of this internal storage is shown in the bottom of each square, such as 200 for AMD1, 201 for BSR7, etc. This address is useful for maintenance personnel to identify which wire is broken.

For each pair of wires interrogated for fire alarms, there is an external output which is latched, to provide a number of alarm functions. The address of this output is also indicated at the bottom of each square in the matrix; for example, #40 for pair of wires AMD-1/AMD2, etc. The output has a LED that will be lit on alarm and can be seen on the S-D 77 front panel. In addition, another LED will be lit on the front door of the alarm panel, pinpointing the exact loop originating the alarm.

In order to sense an input, a small time delay is allowed between the time an output is turned on and an input is sensed because of the time delay of signal flow from the output through the many hundreds or thousands of feet of wire to the input terminal. The time delay is in the order of between 10 and 50 milliseconds. With 12 outputs numbered 100–107 and 110–113 and the 16 inputs, the system can supervise 48 loops.

Figure 8:
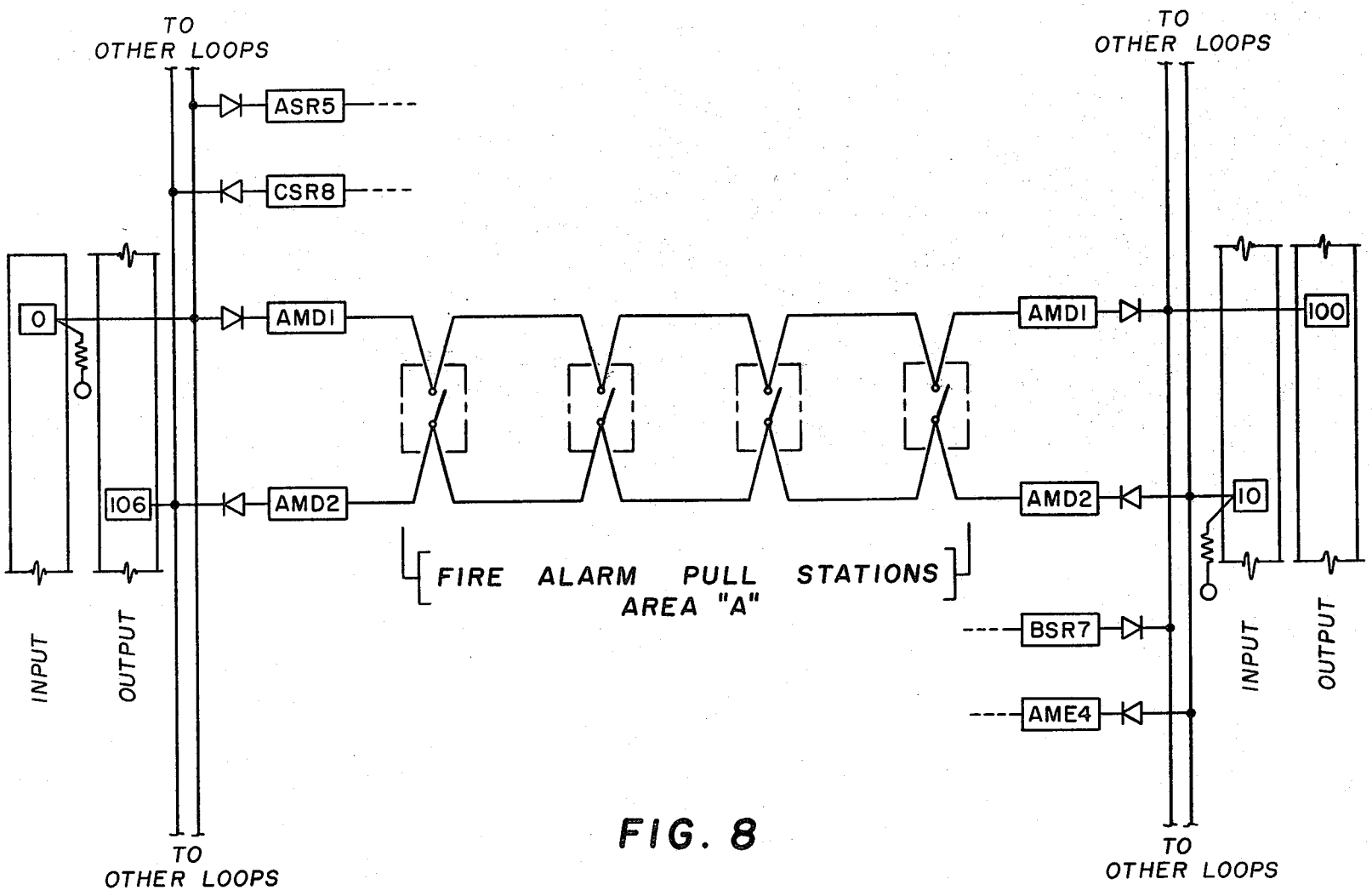
FIG. 8 is a portion of a system embodying the present invention.

Illustrated in FIG. 8 is one loop of the multiloop system with wire and input/output notation corresponding with the notation of the matrix in FIG. 12. Connected across wire AMD1 and AMD2 are a plurality of fire alarm pull stations having normally open contacts. The first step is to supervise the wires AMD1 and others associated with inputs 0–7 as seen from the matrix of FIG. 12. Thereafter, alarm conditions associated with inputs 10–17 are sensed. The controller during the next cycle turns output 101 on and senses conditions at inputs 0–7 and 10–17. The cycle continues turning each output on until output 113 is turned on and the sequence repeats. It will be noted from FIG. 8 that the supervision of line AMD2 takes place with output 106 on and input 10 sensed. This connection is also seen from examination of the matrix of FIG. 12.

Figure 10:
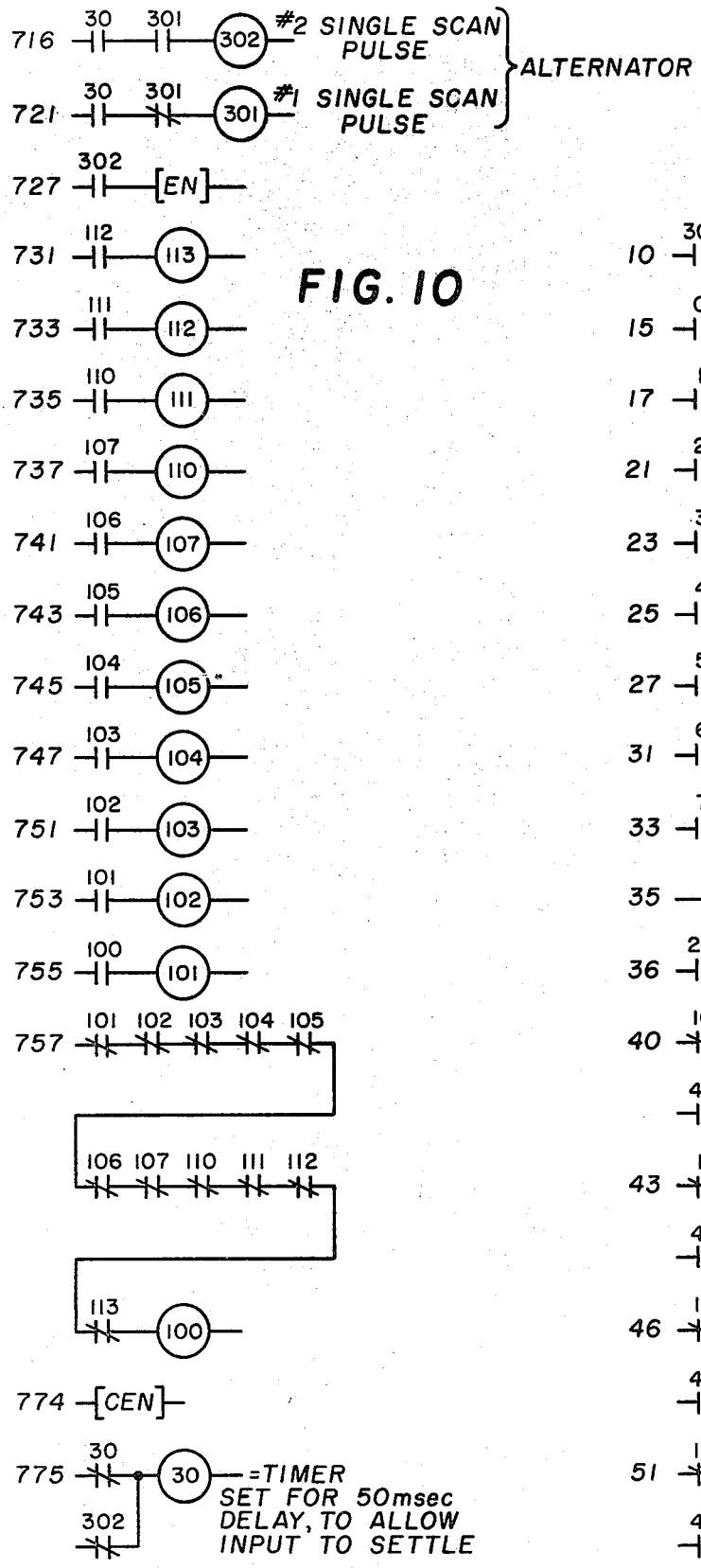
FIGS. 10 and 11 are electric circuit equivalents representative of the logic steps of FIGS. 9A, 9B, and 9C.
Figure 11:
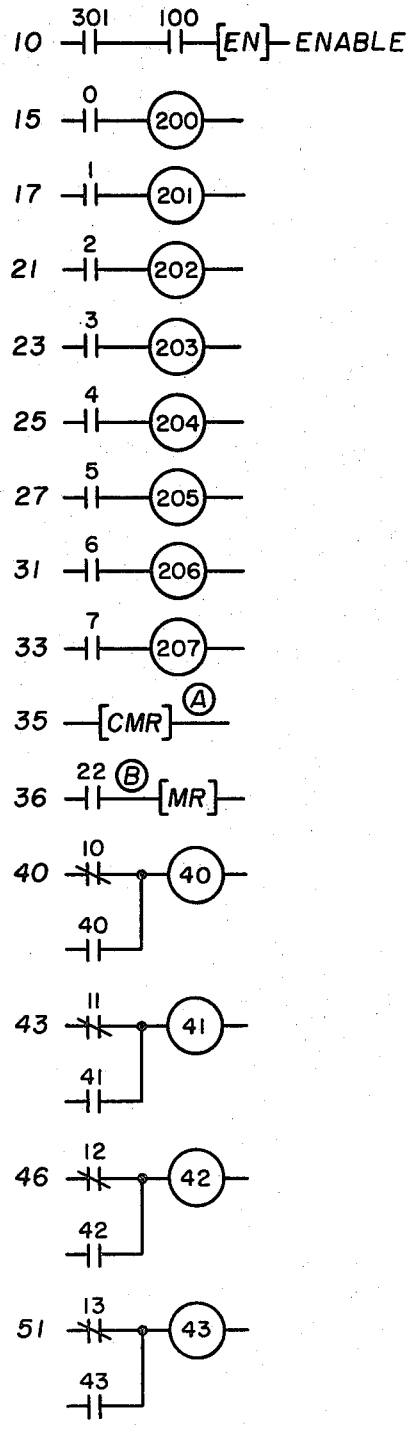

Referring now to TABLE A, which sets forth a portion of the instructions or words for effecting the switching and sensing, and to FIGS. 10 and 11 which illustrate circuit equivalents of the same instructions for the Struthers-Dunn S-D 77 programmable Controller, words 716–723 turn the sequence on and enable an alternator having outputs 301 and 302. When the timer 30 times out, for example, at the end of 50 milliseconds, the first single scan pulse 301 is generated (see word 721). The next step is to check all the inputs associated with a particular output.

TABLE A

| Word | Inst. | Add. | Word | Inst. | Add. | Word | Inst. | Add. |
|---|---|---|---|---|---|---|---|---|
| 10 | LDA | 301 | 44 | OR | 41 | 745 | LDA | 104 |
| 11 | AND | 100 | 45 | STO | 41 | 746 | STO | 105 |
| 12 | EN | | 46 | LDAC | 12 | 747 | LDA | 103 |
| 15 | LDA | 0 | 47 | OR | 42 | 750 | STO | 104 |
| 16 | STO | 200 | 50 | STO | 42 | 751 | LDA | 102 |
| 17 | LDA | 1 | 51 | LDAC | 13 | 752 | STO | 103 |
| 20 | STO | 201 | 716 | LDA | 30 | 753 | LDA | 101 |
| 21 | LDA | 2 | 717 | AND | 301 | 754 | STO | 102 |
| 22 | STO | 202 | 720 | STO | 302 | 755 | LDA | 100 |
| 23 | LDA | 3 | 721 | LDA | 30 | 756 | STO | 101 |
| 24 | STO | 203 | 722 | ANDC | 301 | 757 | LDAC | 100 |
| 25 | LDA | 4 | 723 | STO | 301 | 760 | ANDC | 101 |
| 26 | STO | 204 | 727 | LDA | 302 | 761 | ANDC | 102 |
| 27 | LDA | 5 | 730 | EN | | 762 | ANDC | 103 |
| 30 | STO | 205 | 731 | LDA | 112 | 763 | ANDC | 104 |
| 31 | LDA | 6 | 732 | STO | 113 | 764 | ANDC | 105 |
| 32 | STO | 206 | 733 | LDA | 111 | 765 | ANDC | 106 |
| 33 | LDA | 7 | 734 | STO | 112 | 766 | ANDC | 107 |
| 34 | STO | 207 | 735 | LDA | 110 | 767 | ANDC | 110 |
| 35 | CMR | | 736 | STO | 111 | 770 | ANDC | 111 |
| 36 | LDA | 22 | 737 | LDA | 107 | 771 | ANDC | 112 |
| 37 | MR | | 740 | STO | 110 | 772 | ANDC | 113 |
| 40 | LDAC | 10 | 741 | LDA | 106 | 773 | STO | 100 |
| 41 | OR | 40 | 742 | STO | 107 | 774 | CEN | |
| 42 | STO | 40 | 743 | LDA | 105 | 775 | LDAC | 30 |

TABLE A-continued

| Word | Inst. | Add. | Word | Inst. | Add. | Word | Inst. | Add. |
|---|---|---|---|---|---|---|---|---|
| 43 | LDAC | 11 | 744 | STO | 106 | | | |

This is accomplished through instructions or words 10–51 of TABLE A with circuit equivalents shown in FIG. 11. Instructions and equivalent circuits for inputs 14–17 were intentionally omitted for reason of brevity. With pulse 301 on an output 100 on the procedure is enabled by words 10–12. If a broken wire condition is sensed at any of the inputs 0–7 the condition is stored and later reported as a trouble condition. For example, should the sensing of input 0 indicate a broken wire in the case wire then AMD1 word 15 will cause an internal control relay 200 to be actuated as a flag to indicate trouble.

Fire alarms are sensed beginning with word 40 and if there be an alarm condition a representation will be stored and reported out later in the sequence.

After sequentially selecting one output at a time from 100 through 105, the next outputs 106, 107 and 110–113 will simply reverse the function such that the 106, 107 and 110–113 interrogate for fire alarm on inputs 0 through 7 and perform supervision on inputs 10 through 17.

When the sequence of output selection begins, none of the outputs is ON; therefore, the system steps sequentially to word 757 and turns output 100 ON. The next time word 727 is enabled, word 755 finds output 100 ON, turns output 101 ON and output 100 is turned OFF. The identical procedure is followed every 50 milliseconds plus one scan turning outputs ON and OFF in sequence.

Figure 9A:
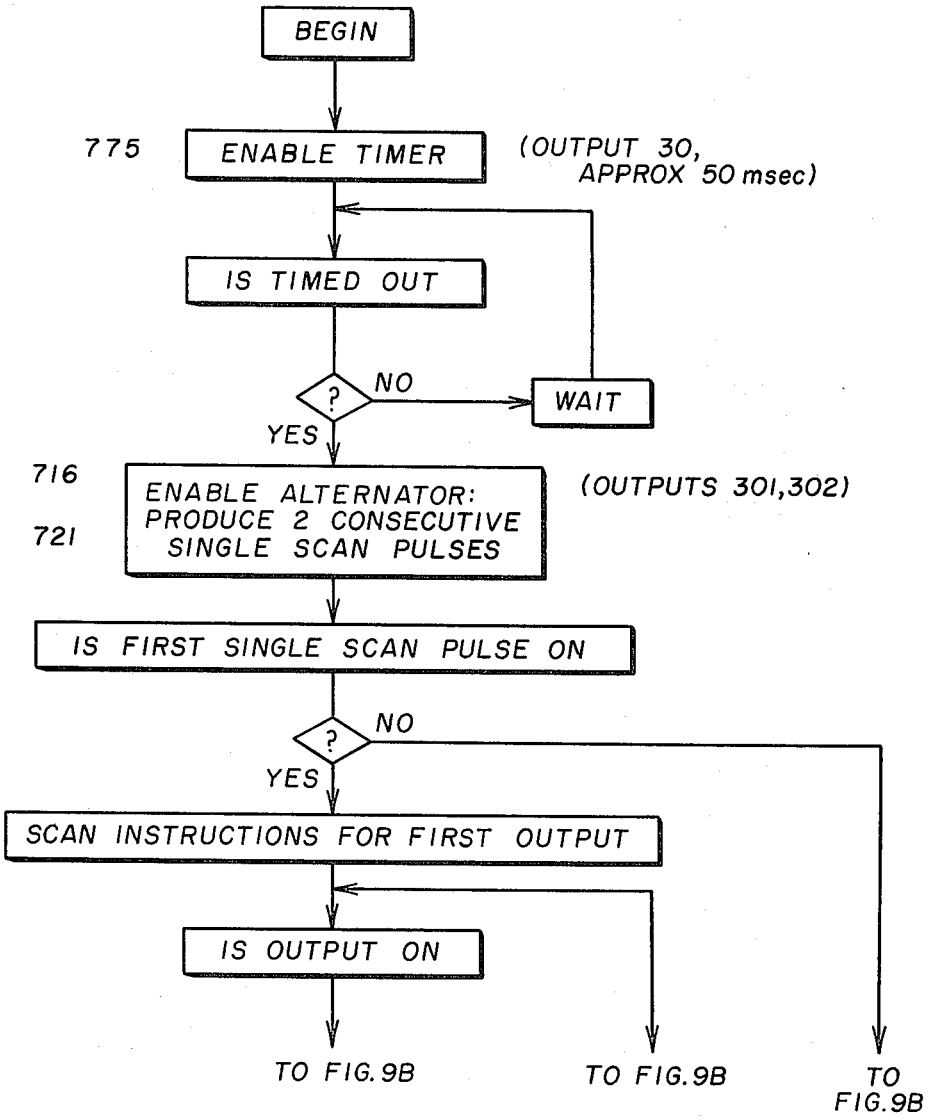
FIGS. 9A, 9B, and 9C illustrate a logic flow diagram descriptive of the process employed in carrying out the present invention.
Figure 9B:
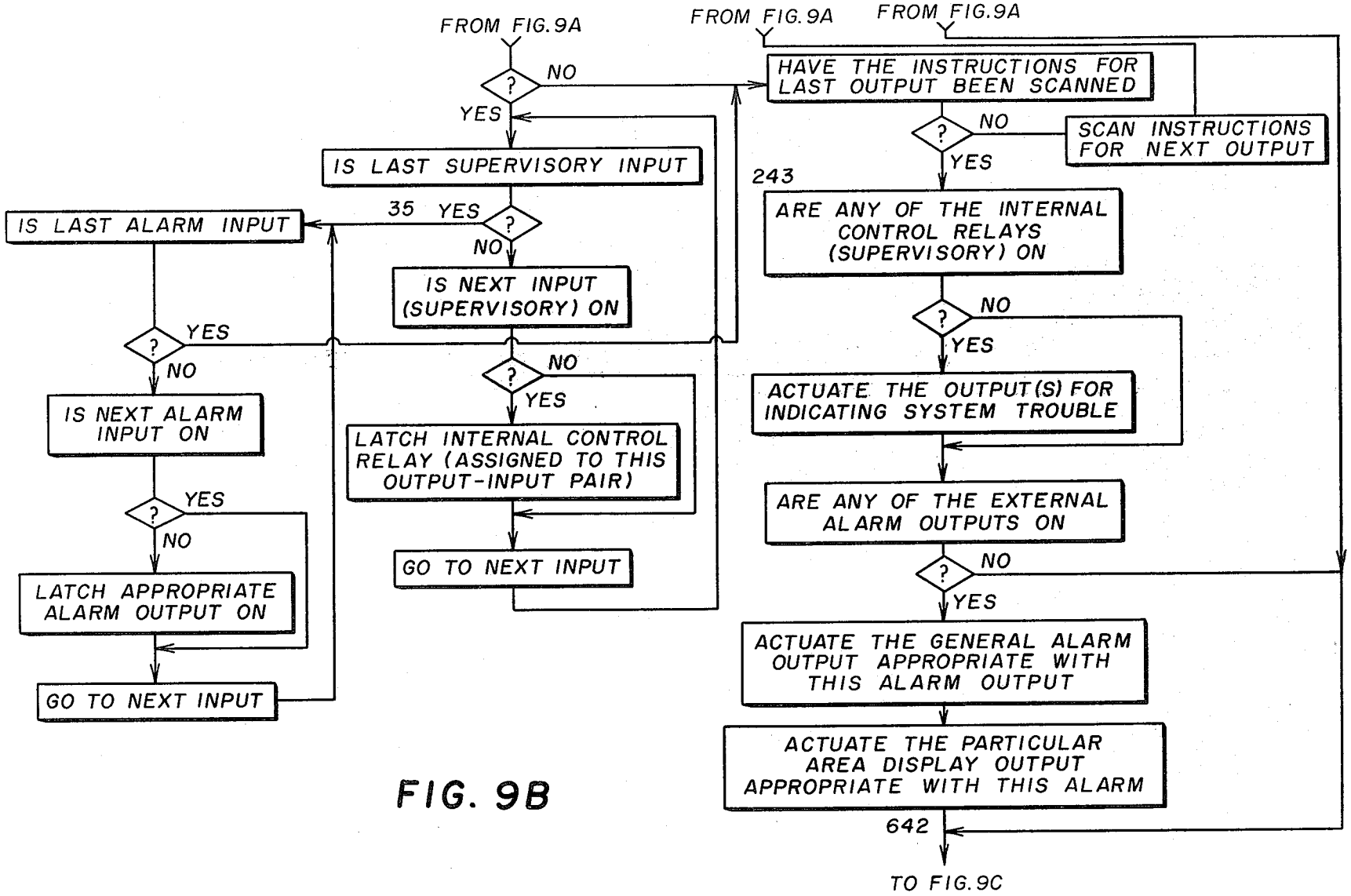
Figure 9C:
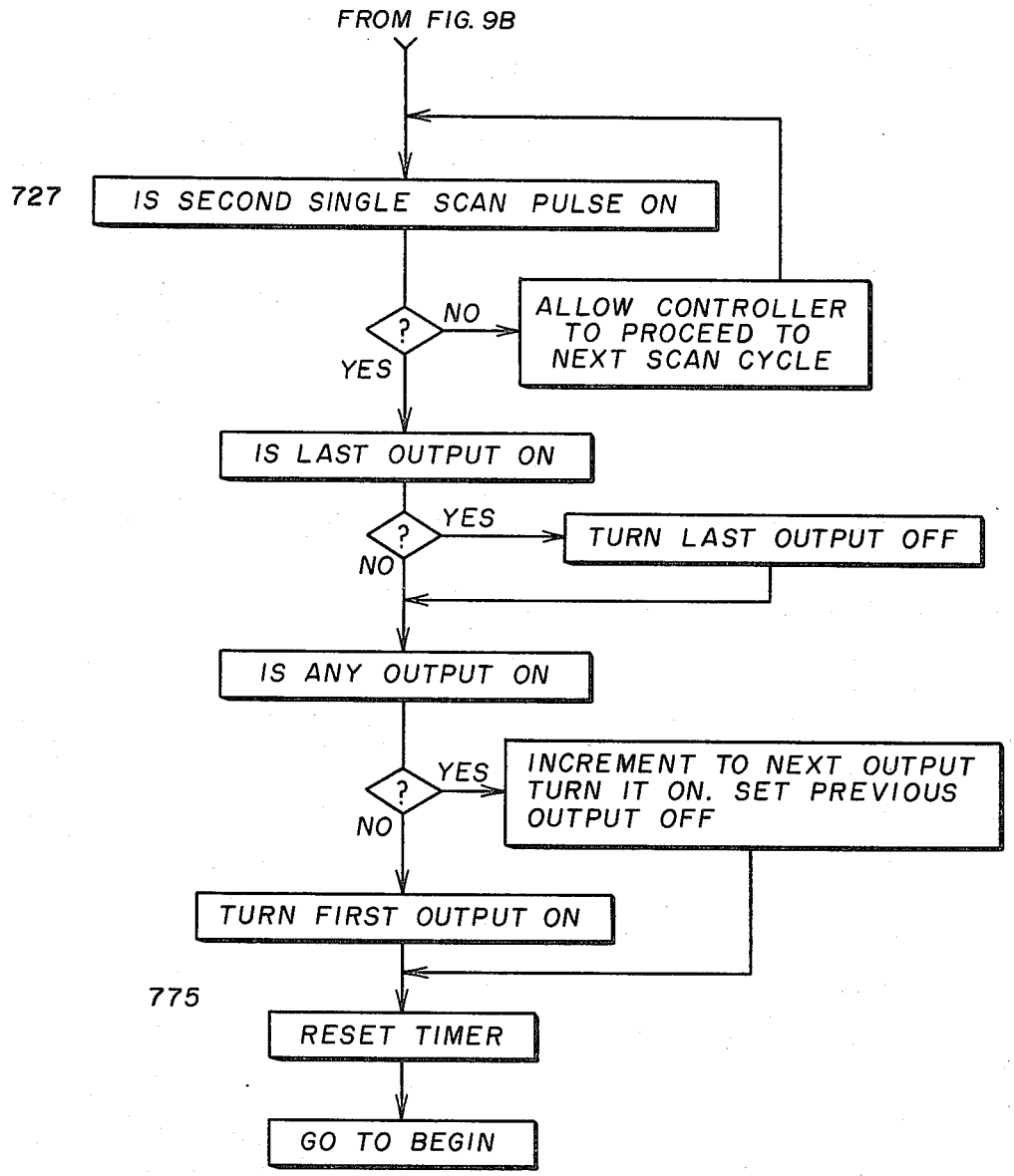

Referring now to the flow charts or logic diagram of FIGS. 9A, 9B and 9C the program is begun by enabling a timer at 775. This will be output 30 and in this particular operation it introduces a delay of about 50 milliseconds. It can be shorter. When the timer is timed out as at 716 the alternator is enabled. This is represented in program (Table A) by words 716, 717, and 720 where output 302 is turned ON or in word 723 where output 301 is turned ON. Output 301 will always be turned ON first; output 302 will be turned ON in the very next scan. Going down through the flow chart, after having produced the first scan the sequence will continue through the selection of which output is ON, asking if the output is ON, and then checking through all the supervisory inputs. Upon completion of the supervisory interrogation FIG. 9, word 35, all the alarm inputs are interrogated. At the end of the input scan the next output is selected by the inquiry "have the instructions for the last output been scanned".

If the answer is "no", the instructions for the next output are scanned. If the answer is "yes", the system scans the internal control relays to determine if there is a supervisory problem and should there be one, reports it. The system then likewise scans for a report of an alarm condition and reports it.

After the report of supervisory and alarm conditions, the system as illustrated in flow diagram FIG. 9C, will turn the first output ON and reset the timer to initiate another complete sequence.

While a specific embodiment of the invention has been shown and described, various modifications are within the true spirit and scope of the invention. For example, a number of other switching systems may be employed, in fact, if desired, the control of the procedure may be governed by a general purpose digital computer. The following claims are, therefore, intended to cover all such modifications.

What is claimed is:

1. The method of sensing conditions in a system including sensors and also including channels having legs communicating with each of the sensors comprising the steps of scanning in a first direction one leg of a channel to determine its integrity, later scanning in a second direction another leg of the same channel to determine its integrity, and subsequently scanning across both legs to determine the condition of the sensor.

2. A condition sensing system including at least one open circuit type environmental sensor having at least two terminals, means for sensing the status of said sensor and including at least two inputs and two outputs, a first conductor extending over a first path from a first of said inputs to a terminal on said sensor and thence by way of a second path to a first of said outputs, a second conductor extending over said second path from a second of said inputs to another of said terminals on said sensor and thence by way of said first path to a second of said outputs, and means for intermittently energizing said first output to sense at said first input the continuity of said first conductor and for intermittently energizing said second output to sense at said second input the continuity of said second conductor.

3. The system of claim 2 in which means is provided for intermittently energizing said first output to sense at said second input the condition of said sensor.

4. The system of claim 3 in which there are included third and fourth conductors, a second normally open environmental sensor having two terminals, said means for sensing the status including third and fourth inputs, said third conductor extending along said second path from said first output to a terminal of said second sensor and thence along said first path to said third input, said fourth conductor extending along said second path from said fourth input to another terminal of said second sensor and thence along said first path to said second output, and means for intermittently energizing said first output to sense at said third input the continuity of said third conductor and for intermittently energizing said second output to sense at said fourth input the continuity of said fourth conductor.

5. The system of claim 4 in which means is provided for intermittently energizing said first output to sense at said fourth input the condition of said second sensor.

6. The system of claim 3 in which there are included third and fourth conductors, a second normally open environmental sensor having two terminals, said means for sensing the status including third and fourth outputs, said third conductor extending along said second path from said third output to a terminal of said second sensor and thence along said first path to said first input, said fourth conductor extending along said first path from said fourth output to another terminal of said second sensor and thence along said second path to said second input, and means for intermittently energizing said third output to sense at said first input the continuity of said third conductor and for intermittently energizing said fourth output to sense at said second input the continuity of said fourth conductor.

7. The system of claim 5 including means for storing representations of sensor conditions, and means responsive to the complete scan of inputs associated with the last output to be turned on for scanning the representations to provide an indication of alarm conditions.

8. The system of claim 4 wherein the number of pairs of conductors, inputs, and outputs bears the relationship:

$$Z=(XY)/4$$

where:

Z=number of pairs of conductors,

X=number of inputs,

Y=number of outputs.

9. The system of claim 5 wherein isolating diodes are connected in series with each conductor at its connection to an input and to an output.

10. The system of claim 9 including means for storing representations of sensor conditions, and means responsive to the complete scan of inputs associated with the last output to be turned on for scanning the representations to provide an indication of alarm conditions.

* * * * *